United States Patent [19]

Creek

[11] 4,449,599

[45] May 22, 1984

[54] FINGER WALKER FOR TUBE SHEET

[75] Inventor: Ronald B. Creek, Chattanooga, Tenn.

[73] Assignee: Combustion Engineering, Inc., Windsor, Conn.

[21] Appl. No.: 423,976

[22] Filed: Sep. 27, 1982

[51] Int. Cl.[3] ..... B25J 5/02; F28G 15/04

[52] U.S. Cl. ..... 180/8.1; 414/750; 165/11 A; 165/76

[58] Field of Search ..... 180/8 R; 414/744, 750, 414/751; 165/11 A, 76, 78

[56] References Cited

U.S. PATENT DOCUMENTS

| | | | |
|---|---|---|---|
| 3,889,820 | 6/1975 | Ranger | 414/750 X |
| 3,913,452 | 10/1975 | Ward et al. | 180/8 R |
| 3,913,752 | 10/1975 | Ward et al. | 414/750 |
| 4,018,344 | 4/1977 | Leshem | 414/751 X |
| 4,018,345 | 4/1977 | Formanek et al. | 414/750 X |
| 4,018,346 | 4/1977 | Leshem et al. | 414/750 X |
| 4,074,814 | 2/1978 | Cooper et al. | 414/751 |
| 4,193,735 | 3/1980 | Savor et al. | 414/744 R |

*Primary Examiner*—John A. Pekar

*Attorney, Agent, or Firm*—L. James Ristas

[57] ABSTRACT

A "finger walker" apparatus for remotely traversing a flat surface having a regular array of openings, such as the tube sheet of a nuclear steam generator. The apparatus has a rectangular base having four base fingers disposed in a rectangular pattern for engagement with the openings. An annular platform surrounds the base and is rotatable about the base. The base is adapted to move linearly a pitch multiple within the platform. Fingers on the platform are adapted for engagement with the openings. The apparatus can orient itself for movement in one of many directions by engaging the platform fingers, disengaging the base fingers and rotating the base until the axis of the base is aligned with the intended direction of travel. The apparatus then advances by alternatingly engaging and disengaging the base and platform fingers in coordination with the base and platform moving linearly relative to each other.

7 Claims, 3 Drawing Figures

FINGER WALKER FOR TUBE SHEET

BACKGROUND OF THE INVENTION

This invention relates to an apparatus for traversing a flat surface having a multiplicity of openings, and in particular to an apparatus for traversing the tube sheet of a nuclear steam generator.

The servicing of steam generators continues to be of major importance in the operation of nuclear plants, particularly those having a pressurized water nuclear steam supply system. These steam generators are in effect large heat exchangers between the primary coolant loop, which is somewhat radioactive, and the secondary, or steam loop, which must be maintained at very low levels of radioactivity. For a variety of reasons, a number of the steam generator tubes deteriorate with time and must be either sleeved or plugged to prevent primary coolant from entering the secondary loop. This and other steam generator maintenance activities are performed during outages when the steam generator can be drained of fluid. Nevertheless, residual radioactivity levels in the steam generator are too high for humans to tolerate safely for the duration of time necessary to make the repairs manually. As a result, the prior art includes a number of remotely-controlled devices, commonly called "finger walkers", for performing various maintenance functions without direct human presence. In particular, such finger walkers are adapted to selectively engage and disengage from the openings in the tube sheet whereby the finger walker may be advanced in one of several directions along the tube sheet. The finger walker typically carries tools with which the tube maintenance or repair operations can be remotely performed.

U.S. Pat. Nos. 3,889,820; 3,913,452; and 3,913,752 are directed to a finger walker having perpendicularly orientated bases which carry fingers for selective insertion into and withdrawal from the tube sheet openings. In this device, the bases move perpendicularly relative to each other in a plane parallel to the tube sheet surface, and the fingers are selectively moveable perpendicularly to the tube sheet and bases.

U.S. Pat. Nos. 4,018,344; 4,018,345; and 4,018,346 are directed to an improvement in the previously described finger walker, wherein the perpendicularly oriented bases are adapted to move relative to each other in a direction perpendicular to the tube sheet, as well as moving relative to each other in a plane parallel to the tube sheet.

U.S. Pat. No. 4,074,814 is directed to a method of sequentially actuating the bases and fingers of the above-type finger walkers.

A more recent improvement to both of the previously described finger walkers is disclosed in U.S. Pat. No. 4,193,735. This improvement provides a rotating platform attached to the finger walker such that a plurality of tools, in sequence, can be deployed at a common area of the tube sheet. In this apparatus, the base members are perpendicularly oriented for moving along "X-Y" incremental directions, with the "X" base and fingers thereon adapted to move also in the direction perpendicular to the tube sheet, whereas the "Y" base equivalent remains in a fixed plane parallel to the tube sheet with the fingers carried thereon being moveable toward and away from the tube sheet.

With all the foregoing prior art finger walkers, advancement of the apparatus along the tube sheet is achieved by sequential movements in either the "X" or "Y" direction by the respective, perpendicularly oriented "X" and "Y" bases.

Although the prior art finger walkers described above have performed satisfactorily in actual field use, their complexity, when coupled with the tendency of tolerances to accumulate as the finger walker traverses the tube sheet, results in occasional failure to advance as required. Human intervention is then necessary to manually relocate the finger walker. Also, the perpendicular orientation of the "X" and "Y" arms is not ideal for traversing a steam generator tube sheet having the tubes spaced on a triangular, rather than square, array. Furthermore, because the fingers carried by the "X-Y" base members are relatively close together, they sometimes loosen when tools carried by the platform or other extension of the finger walker generate unbalanced forces on the fingers when deployed. Thus, the prior art sometimes includes stabilizing fingers on the platform, having no locomotive function whatsoever.

SUMMARY OF THE INVENTION

The foregoing shortcomings of the prior art finger walkers are overcome by the present invention, which eliminates one of the perpendicular "X-Y" base members of the prior art, and substitutes platform fingers uniformly disposed about an annular platform surrounding the remaining base, such that the finger walker is advanced by selective actuation of the base, base fingers, platform, and platform fingers.

The novel finger walker apparatus includes a rectangular base having four base fingers disposed in a rectangular pattern, with the base fingers being adapted to selectively and in unison engage with and disengage from the respective openings in the flat surface of the tube sheet. Base finger insertion means are carried by the base for selectively moving the base fingers perpendicularly toward and away from the surface. An annular platform surrounds the base and is connected thereto by bearing means for relative rotational motion between the base and the platform in a plane substantially parallel to the surface. The platform includes a plurality of platform fingers uniformly disposed about the platform and being adapted to selectively and in unison engage with and disengage from respective openings. Platform finger insertion means are also carried by the platform for selectively moving the platform fingers perpendicularly toward and away from the surface. Also, means are provided for selectively advancing the platform relative to the base in increments of one or two pitches along the major axis of the base.

The apparatus includes control connection means for receiving remote control signals to advance the apparatus in selected one-cycle increments. One such cycle includes inserting the platform fingers into engagement with respective openings in the surface, then withdrawing the base fingers from the surface. The base is then rotated within the platform until the major axis of the base is aligned with the intended direction of travel along the surface. The base fingers are then inserted into and engaged with respective openings, and the platform fingers are disengaged and withdrawn from the surface. The platform is then advanced a pitch multiple relative to the base along the axis direction. The next cycle may be a simple advancement in the same direction by alternating linear movement of the base and platform, or another change in direction may be made by including the step of rotating the base relative to the platform.

An important advantage of the present invention is the ability to orient the base along any intended direction of travel, independent of the orientation of the platform fingers. Thus, the fixed perpendicular relationship of the base members in the prior art is overcome. The present invention enables the finger walker to advance along the tube sheet much closer to the straightest possible line, rather than in a series of mutually perpendicular base member movements as was required in the prior art. Other advantages of the present invention will become apparent in connection with the detailed description of the preferred embodiment.

BRIEF DESCRIPTION OF THE DRAWINGS

The details of the preferred embodiment of the invention will be more fully described with reference to the accompanying drawings, in which.

DESCRIPTION OF THE PREFERRED EMBODIMENT

Figure 1:
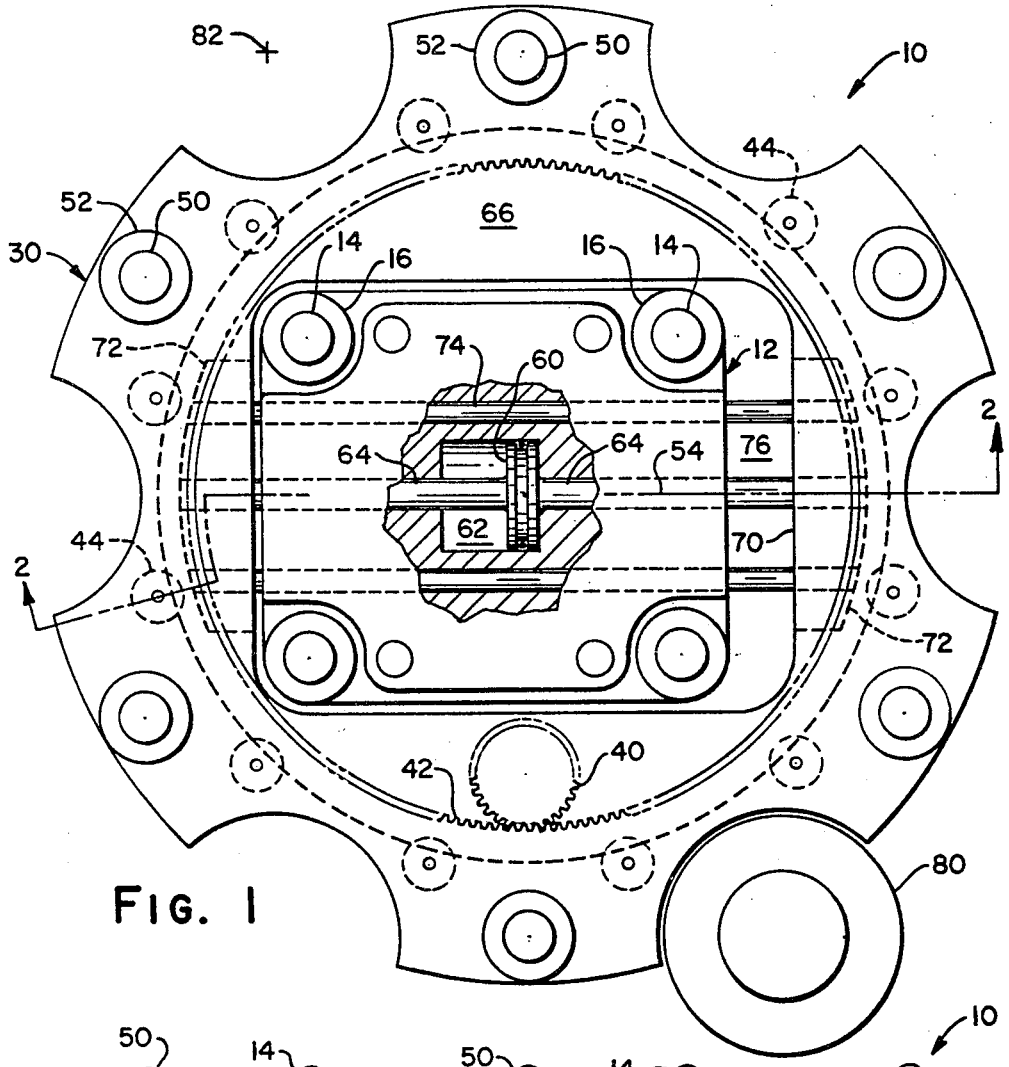
FIG. 1 is a schematic plan view of the invention.
Figure 2:
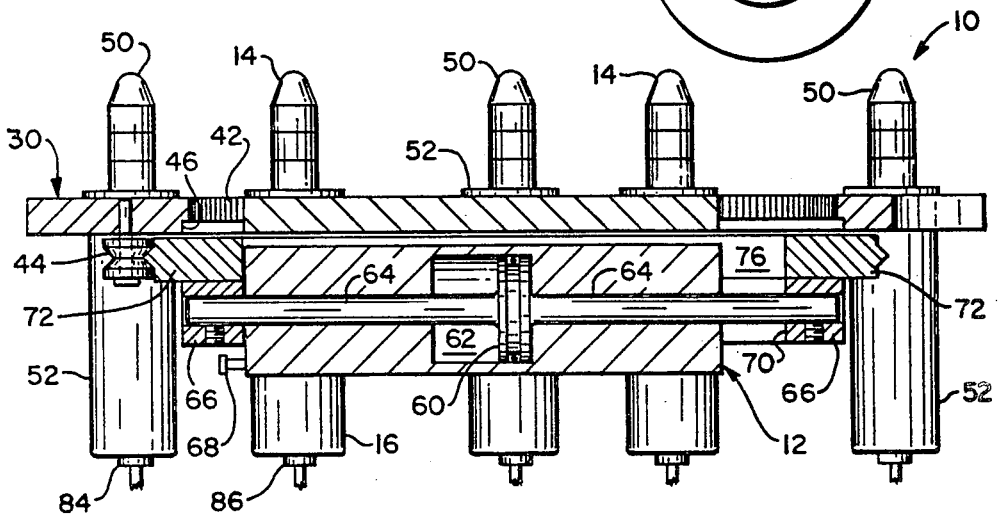
FIG. 2 is a section view along lines 2—2 of FIG. 1, with a portion of the section taken at an angle to the center line or axis of the base.
Figure 3:
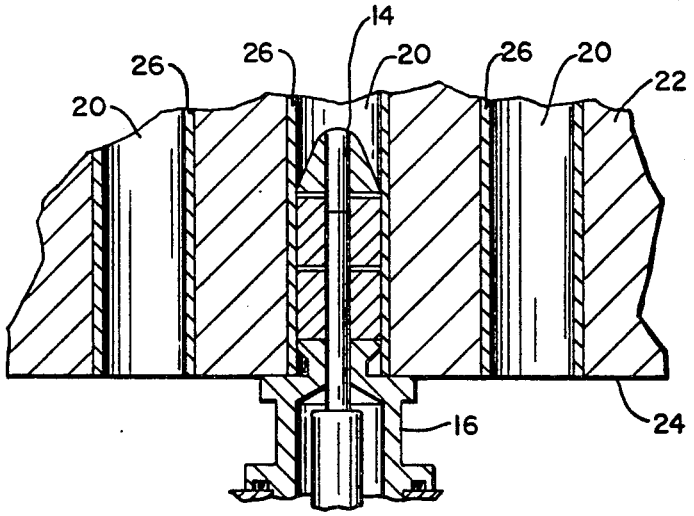
FIG. 3 is a schematic view of a typical finger inserted within an opening of a tube sheet.

FIGS. 1, 2 and 3 illustrate the improved finger walker 10, showing the major components, including a rectangular base 12 having four base fingers 14 disposed in a rectangular pattern such that the centers of each finger correspond exactly to the centers of four respective openings 20 in, for example, a tube sheet 22 of a nuclear steam generator (shown schematically in FIG. 3). In the illustrated embodiment finger actuators 16 expand or contract the fingers 14 within the tubes 26. Preferably, movement toward and away from the tube sheet and the expansion or contraction of the elastomeric finger 14 may be accomplished by a dual purpose actuator, as described in, for example, U.S. Pat. No. 3,889,820 METHOD AND APPARATUS FOR SUSPENDEDLY SUPPORTING A PLATFORM, issued June 17, 1975, the disclosure of which is hereby incorporated by reference.

An annular platform shown generally at 30, surrounds the base 12 and is operatively connected thereto by a motorized gear arrangement 40, 42 and bearing means 44, for relative rotational motion between the base and the platform in a plane substantially parallel to the tube sheet surface 24. This is accomplished in the preferred embodiment by a toothed motor 40 which engages mating teeth on a ring gear 42 "formed on the" inner edge 46 of the annular platform 30.

A plurality of platform fingers 50, including actuating means 52, are uniformly spaced around the platform 30 such that when the four base fingers 16 are engaged with the tube sheet 22, the center line of each platform finger 50 is also centered relative a respective tube sheet opening 20. In the illustrated embodiment, actuator 52 is of the dual type which moves the finger 50 toward and away from the tube sheet and also expands or contracts the flexible portion thereof.

The base 12 includes means for selectively advancing the platform 30 relative to the base 12 in increments of one (or optionally two) pitches along the major axis 54 of the base. In the illustrated embodiment, this is accomplished by providing a piston 60 within a hydraulic chamber 62 in the base, which permits a multiple pitch movement of the piston between the extremities of the chamber. Alternatively, the base could be moved by an electric motor (not shown). The piston includes two push rods 64 rigidly connected to opposite sides of a pillow block 72 mounted on rotation ring 66 intermediate the base 12 and platform 30. Selective actuation on one or the other side of the piston 60, as through control connection means 68, permits the desired relative linear movement between the base and the ring 66. As shown in FIG. 1, the base 12 is confined within a larger rectangular wall opening 70 in the ring 66 within which the relative linear motion occurs and which may also serve as a stop surface.

In the preferred embodiment of the invention, the rotation ring 66 supports the platform 30 for relative rotaton around the base, yet permits the base to move linearly within the platform and ring 66. The rotation ring 66 engages a plurality of circularly spaced bearings 44 which are fixedly connected to the platform 30. When the drive motor 40 is operated to rotate the base relative to the platform, or vice versa, the ring and bearings assure that the platform will remain horizontal or on the same plane as the base fingers, i.e., that the platform will not tilt relative to the base. In the illustrated embodiment, the drive motor 40 is carried by the rotaton ring 66.

Movement of the base within the platform is kept horizontal by stabilizing rods 74 that traverse the base and extend on either side of the push rod 64 into pillow blocks 72 mounted on ring 66.

Referring again to FIGS. 1, 2 and 3, a change-in-direction-of-travel cycle includes the steps of first inserting the platform fingers 50 into engagement with respective openings 20 in the tube sheet 22. The base fingers 14 are withdrawn from the surface 24. The base 12 is then rotated by drive means 40 within the platform 30 until the major axis 54 of the base (the push rod axis) is aligned with the intended direction of travel along the surface. The base fingers 14 are disengaged and withdrawn from the surface. Actuation of the linear advancement piston 60 forces the platform to move relative to the base such that the open area 76 between the base and the ring wall 70 shifts to the center or opposite side of the base with the effect of translating the platform a pitch multiple. In the event the finger walker is to continue traversing the surface in the same direction, the foregoing cycle is repeated without rotating the base within the platform but merely by sequentially engaging and disengaging the platform and base fingers after linear advancement of the platform relative to the base.

If work is to be performed on the tubes 26 at the finger walker location, the platform is rotated relative to the base by the drive motor 40 until the desired tool 80 (only one of six indicated) is brought beneath the target opening (not shown). Once the tool is in the desired location, the platform fingers 50 are inserted and engaged with the respective openings such that the maintenance work may be performed with both the base and platform fingers engaged. This stabilizes the finger walker and platform and permits considerable force to be applied by the tool at the work location. Tool 80 may be rotated into position 82 for example, by disengaging the platform fingers, withdrawing the platform, and rotating the platform while the base fingers remain engaged. In this way a plurality of tools may be brought to a particular tube location in sequence, or in a more advanced scheme, a plurality of tools may operate simultaneously and in sequence on a number of openings in the vicinity of the finger walker.

After work is completed near a particular location, the finger walker may be moved either along the axis of the base, or the previously described change of direction cycle may be repeated by engaging the platform fingers, disengaging the base fingers, and rotating the base relative to the platform so that the finger walker is pointed in the desired direction of travel.

It should be appreciated that the presently described invention has significant advantages over the prior art with respect to efficiency of mechanical operations to effect travel along the surface, and in particular the flexibility to travel in a direct line in, for example, six rather than only four directions. The illustrated embodiment is adapted for use on a tube sheet having a triangular tube array, but use in a square array can readily be accomplished by a different choice of spatial relationships among the various fingers. A typical rectangular pattern of base fingers 14 has a longer center spacing of 6 pitch multiples and a smaller center spacing of 3 pitch multiples. On the platform, the six fingers 50 are at the corners of a regular hexagon with a side equal to 8 pitch multiples. It should be understood that the direction of travel is not continuously variable, i.e., from any given starting location, the finger walker cannot move in unlimited number of directions, but is limited in the illustrated embodiment to six directions. Different tube sheet arrays may impose different limits on the number of directions that the finger walker may move from a fixed initial position. Accordingly, rotation stop means (not shown) are provided to indicate each of the permitted directions relative to the base axis.

The advantages provided by the present invention are a result of eliminating the mutually perpendicular bases required of the prior art devices, and in effect substituting a rotating base to cooperate with a linearly actuable base to achieve greater flexibility. Furthermore, the base and platform fingers are considerably farther apart than is provided with the prior art devices, thereby achieving a stronger support for tool deployment when all fingers are engaged in the tube sheet.

The finger walker device described in U.S. Pat. No. 4,193,735, WORK TABLE FOR A STEPPED PLATFORM, issued on Mar. 18, 1980, has many features common to those of the presently described apparatus, and the disclosure thereof is hereby incorporated by reference. This prior art device illustrates optional techniques for providing the relative rotation between the platform and the inner base members.

It may be appreciated that some of the components of the present invention are adaptations and rearrangements of components disclosed in the incorporated references. Accordingly, the details of the actuating movements are not set forth herein. As is well known, hydraulic, pneumatic and electrical connections are required between the various components of the finger walker and tools carried thereon, and a control panel typically located remotely from the area to be inspected. Representative control connection means for receiving remote control signals to advance the apparatus are shown at 84 and 86, associated with finger actuator 52 and 16, respectively.

I claim:

1. An apparatus for remotely traversing a flat surface having a regular array of identical openings on a uniform pitch, comprising:

a rectangular base having four base fingers disposed in a rectangular pattern, the base fingers being adapted to selectively and in unison engage with and disengage from respective openings;

base finger insertion means carried by the base for selectively moving said base fingers perpendicularly toward and away from the surface;

an annular platform surrounding the base and connected thereto by bearing means for relative rotational motion between the base and platform in a plane substantially parallel to the surface;

a plurality of platform fingers uniformly disposed about the platform, the platform fingers being adapted to selectively and in unison engage with and disengage from respective openings when said base fingers are engaged in respective openings;

platform finger insertion means carried by the platform for selectively moving said platform fingers perpendicularly toward and away from the surface; drive means for rotating the platform relative to the base;

means selectively advancing the platform relative to the base in increments of at least one pitch along the major axis of the base;

control connection means for receiving remote control signals to advance the apparatus one cycle such that, (a) the platform fingers are inserted into and engaged with respective openings, (b) the base fingers are withdrawn from the surface, (c) the base is rotated within the platform until the major axis of the base is aligned with the intended direction of travel along the surface, (d) the base fingers are inserted into and engaged with respective openings, (e) the platform fingers are disengaged and withdrawn from the surface, (f) the platform is advanced a pitch multiple relative to the base along the axis direction; and (g) the platform fingers are inserted into and engaged with respective openings as in (a) above, whereby the entire apparatus has cycled.

2. The apparatus of claim 1 wherein the platform has six platform fingers located at the corners of a regular hexagon.

3. The apparatus of claim 1 further including a rotation ring connected between the base and the platform such that the base moves linearly within the rotation ring and the platform moves rotationally relative to the ring.

4. The apparatus of claim 3 wherein said ring includes a rectangular opening within which the base is adapted to move linearly relative to the ring and platform.

5. The apparatus of claim 4 wherein the means for selectively advancing the platform relative to the base extend outwardly from the base and are rigidly connected to the rotation ring.

6. The apparatus of claim 5 wherein the means for selectively advancing the platform include a push rod fixedly connected to the rotation ring and movable relative to the base.

7. The apparatus of claim 6 wherein the rotation ring includes pillow blocks for securing the push rod.

* * * * *